US006302044B1

(12) United States Patent
Baudet

(10) Patent No.: US 6,302,044 B1
(45) Date of Patent: Oct. 16, 2001

(54) MULTISECTION SAIL BODY AND METHOD FOR MAKING

(75) Inventor: Jean-Pierre Baudet, Emeryville, CA (US)

(73) Assignee: Clear Image Concepts LLC, Emeryville, CA (US)

( * ) Notice: Subject to any disclaimer, the term of this patent is extended or adjusted under 35 U.S.C. 154(b) by 0 days.

(21) Appl. No.: 09/393,132

(22) Filed: Sep. 10, 1999

(51) Int. Cl.[7] ..... B63H 9/04

(52) U.S. Cl. ..... 114/102.33; 114/102.29; 114/102.31

(58) Field of Search ..... 114/113, 102.33, 114/102.31, 102.1, 102.29; 428/110, 111

(56) References Cited

U.S. PATENT DOCUMENTS

| | | |
|---|---|---|
| Re. 33,044 | 9/1989 | Bandy . |
| 2,565,219 | 8/1951 | Gardiner et al. . |
| 3,903,826 | 9/1975 | Andersen . |
| 3,954,076 | 5/1976 | Fracker . |
| 4,133,711 | 1/1979 | August et al. . |
| 4,444,822 | 4/1984 | Doyle et al. . |
| 4,499,842 | 2/1985 | Mahr . |
| 4,554,205 | 11/1985 | Mahr . |

(List continued on next page.)

FOREIGN PATENT DOCUMENTS

| | | |
|---|---|---|
| 2926-476 | 6/1979 | (DE) . |
| 3119-734 | 5/1981 | (DE) . |
| 37 18343 | 12/1988 | (DE) . |
| 0 056 657 A2 | 7/1982 | (EP) . |
| 0 126 614 | 11/1984 | (EP) . |
| 0 224 729 | 6/1987 | (EP) . |
| 0 271 215 | 6/1988 | (EP) . |
| 0271215 | 6/1988 | (EP) . |
| 0 281 322 | 9/1988 | (EP) . |
| 475083 | 3/1992 | (EP) . |
| 0 885 803 | 12/1998 | (EP) . |
| 2016368 | 9/1979 | (GB) . |
| 2280516 | 2/1995 | (GB) . |
| 87/07233 | 12/1987 | (WO) . |
| WO 94/11185 | 5/1994 | (WO) . |
| WO 96/07532 | 3/1996 | (WO) . |

OTHER PUBLICATIONS

J.L. Kardos, "Short–Fiber–Reinforced Polymeric composites, Strucutre–Property Relations," pp. 130–135.

"Consolidation Mechanisms and Interfacial Phenomena in Thermoplastic Powder Impregnated Composites," Section 2.2.1. Tow spreading unit, four pages.

Catalog No. 5, Tools and Hardware for Manufacturing Composite Parts and Laminates of All Types, Torr Technologies, Inc., Auburn, Washington.

*Primary Examiner*—S. Joseph Morano
*Assistant Examiner*—Lars A. Olson
(74) *Attorney, Agent, or Firm*—James F. Hann; Haynes Beffel & Wolfeld LLP

(57) ABSTRACT

A sail body (3), which can be finished along its edges and corners to create a finished sail (2), includes a number of sail sections(46) joined along their edges (47). Each sail section includes a reinforced material (20) laminated between first and second films (32,42). The reinforced material includes sectors of reinforced material (30,31), each sector having a set of generally parallel reinforcement elements (24), such as fibers. The sectors of reinforced material are preferably elongate sectors in which at least the majority of the sectors have lengths (34) at least five times as long their widths (36). The sectors are arranged in an overlapping pattern and so that the set of reinforcement elements are generally aligned with the expected load lines (28)for that section of the sail body. Sections can be made of different shapes but are typically triangular or quadrilateral. The reinforce material is typically a mesh or scrim containing sets of parallel, transversely oriented fibers (24,26). The mesh or scrim can either woven or unwoven.

15 Claims, 3 Drawing Sheets

U.S. PATENT DOCUMENTS

| | | | | |
|---|---|---|---|---|
| 4,590,121 | | 5/1986 | Mahr . | |
| 4,593,639 | | 6/1986 | Conrad . | |
| 4,624,205 | | 11/1986 | Conrad . | |
| 4,679,519 | | 7/1987 | Linville . | |
| 4,708,080 | | 11/1987 | Conrad | 114/113 |
| 4,831,953 | | 5/1989 | Conrad . | |
| 4,945,848 | | 8/1990 | Linville | 428/110 |
| 5,001,003 | | 3/1991 | Mahr . | |
| 5,014,755 | * | 5/1991 | Bompard et al. | 428/110 |
| 5,038,700 | | 8/1991 | Conrad . | |
| 5,097,783 | | 3/1992 | Linville . | |
| 5,097,784 | | 3/1992 | Baudet | 428/110 |
| 5,172,647 | | 12/1992 | Towne . | |
| 5,304,414 | | 4/1994 | Bainbridge et al. . | |
| 5,333,568 | | 8/1994 | Meldner et al. . | |
| 5,352,311 | | 10/1994 | Quigley . | |
| 5,355,820 | | 10/1994 | Conrad et al. . | |
| 5,403,641 | | 4/1995 | Linville et al. . | |
| 5,470,632 | | 11/1995 | Meldner et al. . | |
| 5,643,522 | | 7/1997 | Park . | |
| 6,090,234 | * | 7/2000 | Barone et al. | 428/110 |
| 6,112,689 | * | 9/2000 | Baudet | 114/102.33 |

* cited by examiner

MULTISECTION SAIL BODY AND METHOD FOR MAKING

BACKGROUND OF THE INVENTION

The present invention is directed to the field of sails and methods for their manufacture.

Sails can be flat, two-dimensional sails or three-dimensional sails. Most typically, three-dimensional sails are made by broadseaming a number of panels. The panels, each being a finished sector of sailcloth, are cut along a curve and assembled to other panels to create the three-dimensional aspect for the sail. The panels typically have a quadrilateral or triangular shape with a maximum width being limited traditionally by the width of the roll of finished sailcloth from which they are being cut. Typically the widths of the sailcloth rolls range between about 91.5 and 137 centimeters (36 and 58 inches).

Sailmakers have many restraints and conditions placed on them. In addition to building products which will resist deterioration from weather and chafe abuses, a goal of modem sailmaking is to create a lightweight, flexible, three-dimensional air foil that will maintain its desired aerodynamic shape through a chosen wind range. A key factor in achieving this goal is stretch control of the airfoil. Stretch is to be avoided for two main reasons. First, it distorts the sail shape as the wind increases, making the sail deeper and moving the draft aft. This creates undesired drag as well as excessive heeling of the boat. Second, sail stretch wastes precious wind energy that should be transferred to the sailcraft through its rigging.

Over the years, sailmakers have attempted to control stretch and the resulting undesired distortion of the sail in three basic ways.

The first way sailmakers attempted to control sail stretch is by using low-stretch high modulus yarns in the making of the sailcloth. The specific tensile modulus in gr/denier is about 30 for cotton yarns (used in the 1940's), about 100 for Dacron® polyester yarns from DuPont(used in the 1950's to 1970's), about 900 for Kevlar® para-aramid yarns from DuPont (used in 1980's) and about 3000 for carbon yarns (used in 1990's).

The second basic way sailmakers have attempted to control sail stretch has involved better yam alignment based on better understanding of stress distribution in the finished sail. Lighter and yet lower-stretch sails have been made by optimizing sailcloth weight and strength and working on yarn alignment to match more accurately the encountered stress intensities and their directions. The efforts have included both fill-oriented films. With better understanding of the stress distribution, sailmaking has evolved towards more sophisticated panel-layout constructions. Up until the late 1970's, sails were principally made out of narrow panels of fill-oriented woven sailcloth arranged in cross-cut construction where the majority of the loads were crossing the seams and the width of the narrow panels. With the appearance of high-performance yarn material, like Kevlar, stretch of the numerous horizontal seams in the sails became a problem. To solve this and to better match the yarn alignment with the load patterns, an approach since the early 1980's has been to arrange and seam narrow panels of warp-oriented sailcloths in panel-layout constructions known as "Leech-cut" and later more successfully in the "Tri-radial" construction. The "Tri-radial" construction is typically broken into several sections made from narrow pre-assembled radiating panels. The highly loaded sections of the sail such as the clew, the head and the leech sections are typically made with radial panels cut from heavy sailcloth. The less loaded sail sections, such as the luff and the tack sections, are made with panels cut from lighter sailcloth. This approach, unfortunately, has its own drawbacks. Large sails made this way can have up to, for example, 120 narrow panels which must be cut and broadseamed to each other with great precision to form the several large sections. These large sections of pre-assembled panels are then joined together to form the sail. This is extremely time-consuming, and thus expensive, and any lack of precision often results in sail-shape irregularities. The mix of types of sailcloths used causes the different panels to shrink at different rates affecting the smoothness of the sail along the joining seams of the different sections, especially over time.

An approach to control sail-stretch has been to build a more traditional sail out of conventional woven fill-oriented sailcloth panels and to reinforce it externally by applying flat tapes on top of the panels following the anticipated load lines. See U.S. Pat. No. 4,593,639. While this approach is relatively inexpensive, it has its own drawbacks. The reinforcing tapes can shrink faster than the sailcloth between the tapes resulting in severe shape irregularities. The unsupported sailcloth between the tapes often bulges, affecting the design of the airfoil.

A further approach has been to manufacture narrow cross-cut panels of sailcloth having individual laid-up yarns following the load lines. The individual yarns are sandwiched between two films and are continuous within each panel. See U.S. Pat. No. 4,708,080 to Conrad. Because the individual radiating yarns are continuous within each panel, there is a fixed relationship between yarn trajectories and the yarn densities achieved. This makes it difficult to optimize yarn densities within each panel. Due to the limited width of the panels, the problem of having a large number of horizontal seams is inherent to this cross-cut approach. The narrow cross-cut panels of sailcloth made from individual spaced-apart radiating yarns are difficult to seam successfully; the stitching does not hold on the individual yarns. Even when the seams are secured together by adhesive to minimize the stitching, the proximity of horizontal seams to the highly loaded corners can be a source of seam, and thus sail, failure.

A still further approach has been to manufacture simultaneously the sailcloth and the sail in one sector on a convex mold using uninterrupted load-bearing yarns laminated between two films, the yarns following the anticipated load lines. See U.S. Pat. No. 5,097,784 to Baudet. While providing very light and low-stretch sails, this method has its own technical and economic drawbacks. The uninterrupted nature of every yarn makes it difficult to optimize yarn densities, especially at the sail corners. Also, the specialized nature of the equipment needed for each individual sail makes this a somewhat capital-intensive and thus expensive way to manufacture sails.

The third basic way sailmakers have controlled stretch and maintained proper sail shape has been to reduce the crimp or geometrical stretch of the yarn used in the sailcloths. Crimp is usually considered to be due to a serpentine path taken by a yarn in the sailcloth. In a weave, for instance, the fill and warp yarns are going up and down around each other. This prevents them from being straight and thus from initially fully resisting stretching. When the woven sailcloth is loaded, the yarns tend to straighten before they can begin resist stretching based on their tensile strength and resistance to elongation. Crimp therefore delays and reduces the stretch resistance of the yarns at the time of the loading of the sailcloth.

In an effort to eliminate the problems of this "weave-crimp", much work has been done to depart from using woven sailcloths. In most cases, woven sailcloths have been replaced by composite sailcloths, typically made up from individual laid-up (non-woven) load-bearing yarns sandwiched between two films of Mylar® polyester film from DuPont or some other suitable film. There are a number of patents in this area, such as Sparkman EP 0 224 729, Linville U.S. Pat. No. 4,679,519, Conrad U.S. Pat. No. 4,708,080, Linville U.S. Pat. No. 4,945,848, Baudet U.S. Pat. No. 5,097,784, Meldner U.S. Pat. No. 5,333,568, and Linville U.S. Pat. No. 5,403,641.

Crimp, however, is not limited to woven sailcloth and can occur with laid-up constructions also. Crimp in sailcloth made of laid-up yarn can be created in several different ways. First, lateral shrinkage of the films during many conventional lamination processes induces crimp into the yarns. For example, with narrow crosscut panel construction, where a majority of load-bearing yarns are crossing the panel widths, significant crimp of these yarns is induced during lamination of the sailcloth between high-pressure heated rolls. This is because the heated film shrinks laterally as it undergoes thermoforming, typically about 2.5% with this lamination method. The result is catastrophic with regard to the stretch performance for the composite fabric in highly loaded applications.

Second, uninterrupted load-bearing yarns within a sail follow curved trajectories. The yarns used are typically multifiber yarns. Twist is generally added so that the fibers work together and resist stretch along the curved trajectories. If no twist were added, only a few fibers would be submitted to the loads, that is the ones on the outside of the curve. This would substantially limit the ability of the sail to resist stretch. While the tiny yarn spirals created using the twisted multi-fiber yarns help increase load sharing amongst the fibers and therefore reduce stretch, there is still crimp induced as the spiraled yarns straighten under the loads. The twist in the yarns is therefore a necessary compromise for this design, preventing however this type of sailcloth from obtaining the maximum possible modulus from the yarns used.

The various approaches shown in Linville's patents are other attempts to reduce crimp problems. Layers of continuous parallel spaced-apart laid-up yarns are used to reinforce laminated sailcloth. However, because the continuous spaced-apart yarns are parallel to each other, only a small number of them are aligned with the loads. Panels cut out of these sailcloths therefore have poor shear resistance. In addition, no change of yarn density is achieved along the yarns direction. Therefore the proposed designs do not offer constant strain qualities. In addition, these approaches are designed to be used with panel-layout like the Cross-cut, Leech-cut and Tri-radial constructions, which result in their own sets of drawbacks.

The sailcloth shown in Meldner's patent may, in theory, reduce crimp problems. However, it is designed to be used in Tri-radial construction, which results in its own set of problems. Meldner laminates between two films continuous layers of unidirectional unitapes made from side-by-side pull-truded tows of filaments with diameters five times less than conventional yarns. The continuous unidirectional layers are crossing-over each other to increase filament-over-filament cross-over density, which is believed to minimize crimp problems and increase shear strength. Meldner is limited to the use of very small high performance yarns, which are expensive. The cost of those yarns affects greatly the economics of this approach and limits it to "Grand Prix" racing applications. In addition, this design of sailcloth is not intended to offer constant strain qualities; rather stretch and strength resistance are designed to be the same throughout the entire roll length of the sailcloth. Only a small number of the continuous unidirectional filaments end up aligned with the loads.

U.S. patent application Ser. No. 09/173,917 filed Oct. 16, 1998 and entitled Composite Products, Methods and Apparatus, describes a low stretch, flexible composite particularly useful for making high performance sails. The composite includes first and second polymer films with discontinuous, stretch resistant segments therebetween. The segments extend generally along the expected load lines for the sail. The segments have lengths which are substantially shorter than the corresponding lengths of the load lines within each sail section. The sail can be either two-dimensional or three dimensional. The two-dimensional sails can be made from one section or a number of flat sections seamed together. Three dimensional sails can be made using one or more molded sections of the composite sheet or several flat sections can be broad seamed together to create the three dimensional sail. The sail can be designed to exhibit generally constant strain qualities under a desired use condition and to permit low stretch performance to be optimized by minimizing the crimp, that is the geometrical stretch, of the yarns.

SUMMARY OF THE INVENTION

The present invention is directed to a sail body and a method for making a sail body which is particularly useful for making relatively large sails using a reduced number of sail sections. For example, a large multiple section sail for an 80 foot boat will use 35 to 40 sections for a conventional cross cut sail and about 120 panels pre-assembled into 5 or 6 large sections for a conventional tri-radial sail. In contrast, that same sail made according to the invention can be made from 5 or 6 sail sections thus reducing the cost for the sail.

The sail body, which can be finished along its edges and corners to create a finished sail, includes a number of sail sections joined along their edges. Each sail section includes a reinforced material laminated between first and second films. The reinforced material includes sectors of reinforced material, each sector having a set of generally parallel reinforcement elements, such as fibers. The sectors are arranged in an overlapping pattern and so that the set of reinforcement elements are generally aligned with the expected load lines for that section of the sail body. The sectors of reinforced material are preferably elongate sectors in which at least the majority of the sectors have lengths at least three times as long as their widths. Sections can be made of different shapes but are typically triangular or quadrilateral. The reinforced material is typically a mesh or scrim containing sets of parallel, transversely oriented fibers. The mesh or scrim can be either woven or unwoven.

According to another aspect of the invention, a sail body is made from a plurality of sail sections by arranging elongate sectors of reinforced material on a first film in an overlapping pattern, each sector having a set of generally parallel reinforcement elements, such as fibers. The sectors of reinforced material are preferably elongate sectors in which at least the majority of the sectors have lengths which are at least three times as long as their widths. The arranged sectors of reinforced material are laminated between first and second films to form a sail section. The sectors are preferably arranged so that the set of generally parallel reinforcement elements are generally aligned with the expected load lines for that sail section of the sail body. The reinforced material is preferably a prepreg material, that is a material that is impregnated with an uncured adhesive. The arranging step may be carried out using, for example, triangular or quadrilateral sectors of the material. The sail sections are typically joined by broad seaming the sail sections to one another along their adjacent edges.

Other features and advantages of the invention will appear from the following description in which the preferred embodiments have been set forth in detail in conjunction with the accompanying drawings.

DESCRIPTION OF THE SPECIFIC EMBODIMENTS

Figure 1:
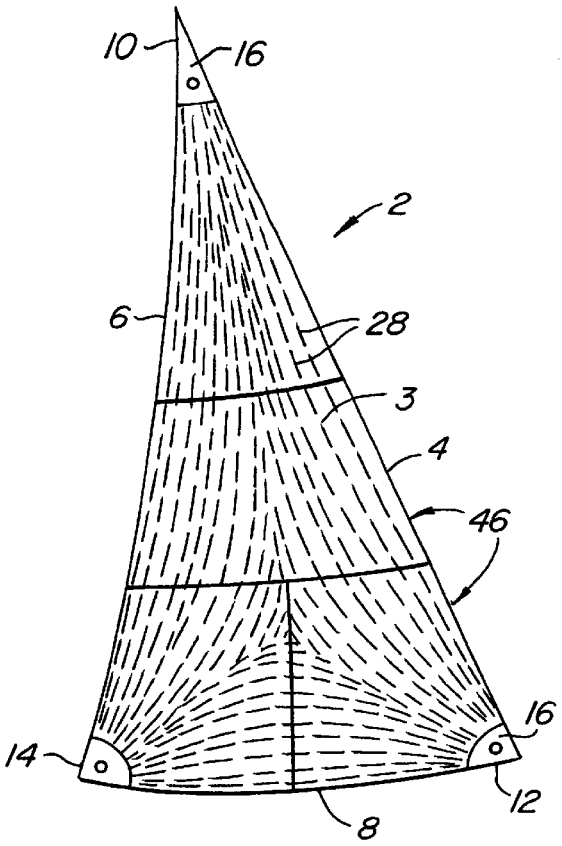
FIG. 1 is a plan view of a sail made according to the present invention with an exemplary set of expected load lines shown in dashed lines.

FIG. 1 illustrates a sail 2 made according to the invention. In this embodiment sail 2 includes a sail body 3 and has three edges, luff 4, leech 6 and foot 8.

Sail 2 also has three corners, head 10 at the top, tack 12 at the lower forward corner of the sail at the intersection of luff 4 and foot 8, and clew 14 a the lower aft corner of the sail at the intersection of the leech and the foot. While sail 2 is typically a molded, generally triangular, three-dimensional sail, it could also be a two-dimensional sail and could have any of a variety of shapes. The finished sail 2 includes gussets 16 at head 10, tack 12 and clew 14 and selvage along luff 4, leech 6 and foot 8 to create the finished sail. A process suitable for making sail body 3 and its construction will now be discussed.

Figure 2:
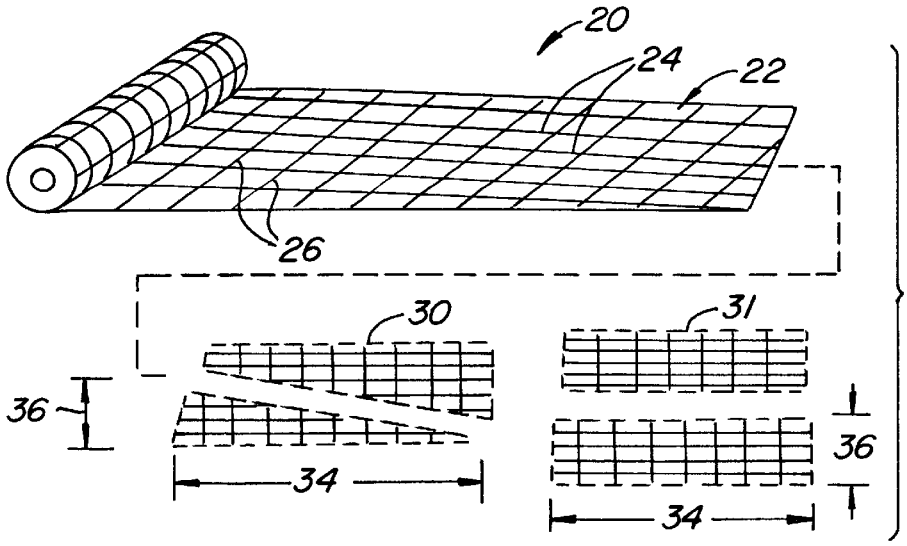
FIG. 2 schematically illustrates cutting sectors of reinforced material from a roll of reinforced material.

FIG. 2 illustrates a roll of adhesive-impregnated, uncured reinforced material 20, also called a prepreg or a prepreg material. Material 20 is typically made of an uncured adhesive such as a copolyester resin, and a mesh or scrim 22 of fibers or other reinforcement elements. The mesh or scrim 22 will typically be unwoven but may be woven for increased tear resistance. Mesh or scrim 22 preferably includes a set of first reinforcement elements 24 which run parallel to one another along the length of material 20 and a set of second, generally parallel reinforcement elements 26 which are arranged transversely to, typically perpendicular to, reinforcement elements 28. Reinforcement elements 24, 26 can be made from a variety of materials such as monofilament material, multifiber yarns made of, for example, carbon fiber, aramid fiber, polyester fiber or fiber sold under the trademarks PBO®, Pentex® or Spectra®. Reinforcement elements may be, for example, cylindrical or flattened in cross-section and may be made of twisted or untwisted fibers. Reinforcement elements 24 are typically, but need not be, the fibers used to be generally aligned with the expected load lines 28 of sail 2.

In one embodiment, first and second reinforcement elements 24, 26 are made of 500 denier untwisted multifiber yarns and twisted multifiber yarns, respectively. Second reinforcement elements 26 are preferably twisted multifiber yarns for increased tear resistance. The spacing between first reinforcement elements 24 is, in one embodiment, about 3 mm and the spacing between second reinforcements elements is about 10 mm. However, the first and second reinforcement elements 24, 26 could be made of different materials and could be made with the same or different diameters. Also, the reinforcement elements could have equal or unequal lateral spacing as well. The choice of reinforcement elements 24, 26, their orientation and their spacing will be determined in large part by the expected loading of sail 2.

Figure 3:
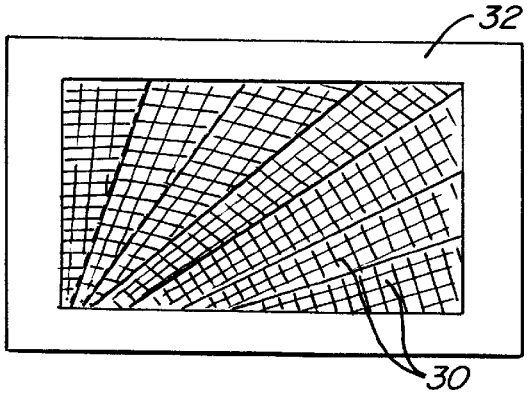
FIG. 3 illustrates arranging a single layer of triangular sectors of reinforced material on a film.
Figure 4:
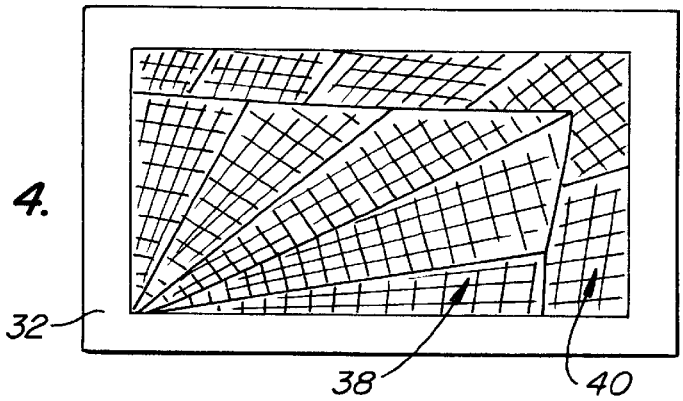
FIG. 4 illustrates arranging two layers of triangular sectors of reinforced material on a film.
Figure 5:
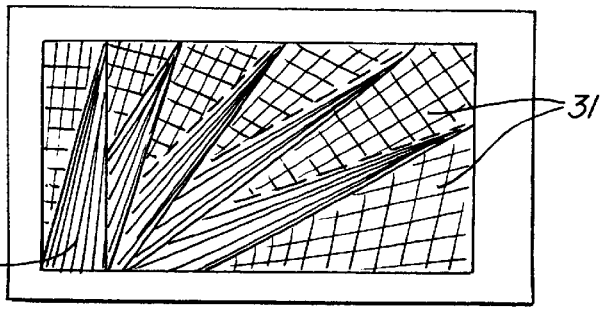
FIG. 5 illustrates arranging quadrilateral sectors of reinforced material on a film.

Material 20 is cut into sectors 30, 31 of prepreg material 20 of various shapes and sizes, but typically triangular and quadrilateral, as suggested in FIG. 2. FIG. 3 illustrates arranging triangular sectors 30 with their edges slightly overlapping on to a first, imperforate film 32, film 32 typically made of PET, polyester film or other materials such as Kapton® polyimide film made by Dupont. Each sector 30, 31 has a length 34 and a width 36, the average length being substantially, typically at least about three to ten times, and more preferably at least about five times, the average width. First, longitudinally-extending reinforcement elements 24 are typically parallel to length 34. Pieces 30, 31 are sized, cut and arranged so that reinforcement elements, typically first reinforcement elements 24, will generally parallel expected load lines 28 when sail 2 is assembled. FIG. 4 illustrates a double layer of triangular sectors 30 with the upper layer 38 not extending over the same surface area as the lower layer 40. FIG. 5 illustrates overlapping of quadrilateral sectors 31 with the most extensive overlapping taking place at the lower left corner 41 to correspond to the concentration of expected load lines 28 at that region. When making multiple-layer sections, the sectors may be butt-joined together within each layer to help create a smoother finished product. Of course other arrangements, sizes and shapes of sectors could also be used.

Figure 7:
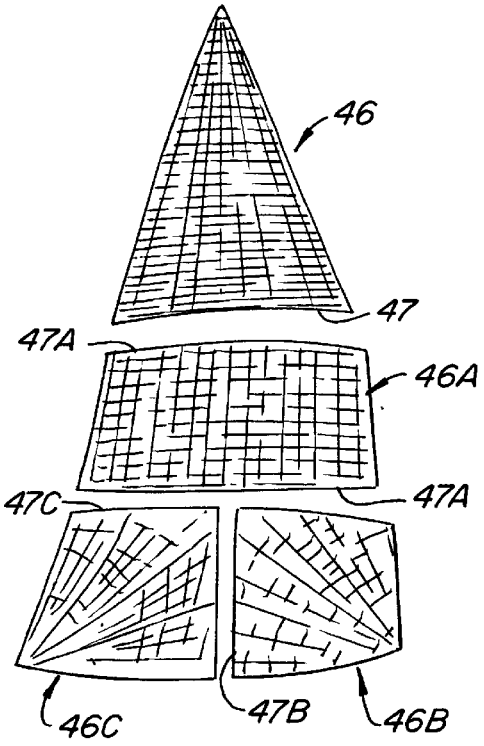
FIG. 7 suggests how a set of sail sections can be joined to create a sail body.
Figure 6:
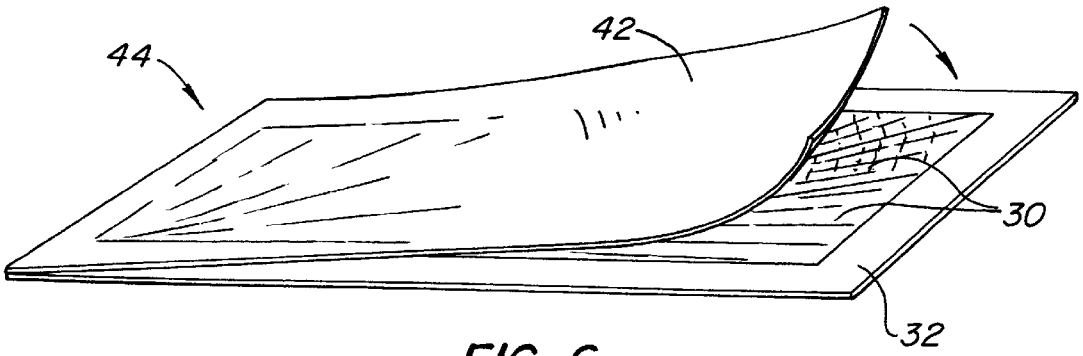
FIG. 6 illustrates capturing sectors of reinforced material between two films to create an uncut sail section.

FIG. 6 illustrates capturing sectors 30 between first film 32 and a second film 42. Pieces 30, 31 of reinforced material 20, first film 32 and second film 42 may be laminated in any of a variety of conventional or unconventional fashions. If desired, additional adhesives may be used between films 32, 42. Also, reinforced material 20 may be made without any adhesive so that all the adhesive is applied as a separate step prior to lamination. After lamination, the combination of sectors 30,31, films 32, 42 and the adhesive bonding the layers constitute an uncut sail section 44, typically generally rectangular in shape. Uncut sail section 44 is then cut to the appropriate shape to create a sail section 46 as shown in FIG. 7. Sail body 3, in this embodiment, is made by assembling, typically broad seaming, four different sail sections 46 together along their adjacent edges 47, 47A, 47B, 47C. In addition to triangular sail section 46, sail 2 is also made from three different quadrilateral sail sections 46A, 46B and 46C. By comparing expected load lines on sail 1 with the suggested orientations of the reinforcement elements 24, 26, in particular the longitudinally-extending the reinforcement elements 24, it is seen that the reinforcement elements are generally aligned with the expected load lines.

Figure 8:
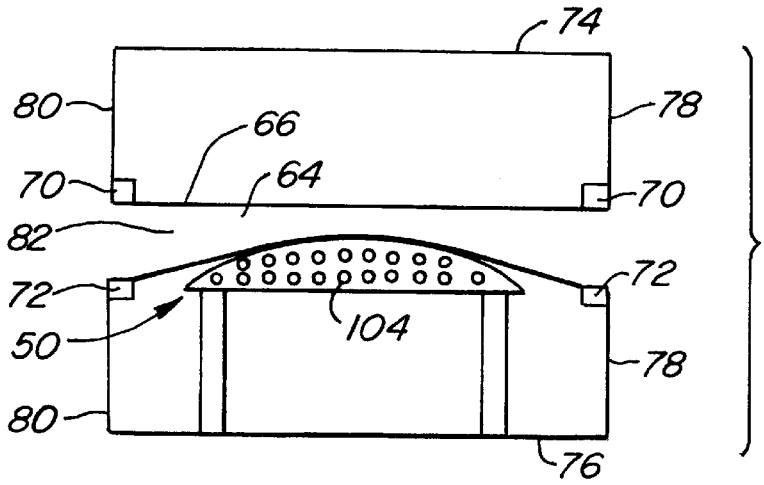
FIG. 8 is a simplified end view illustrating placement of the material stack of FIG. 6 between two high-friction, flexible pressure sheets stretched between frames, the frames carried by upper and lower enclosure members, with a three-dimensional mold element used to create a molded sail body.
Figure 8A:
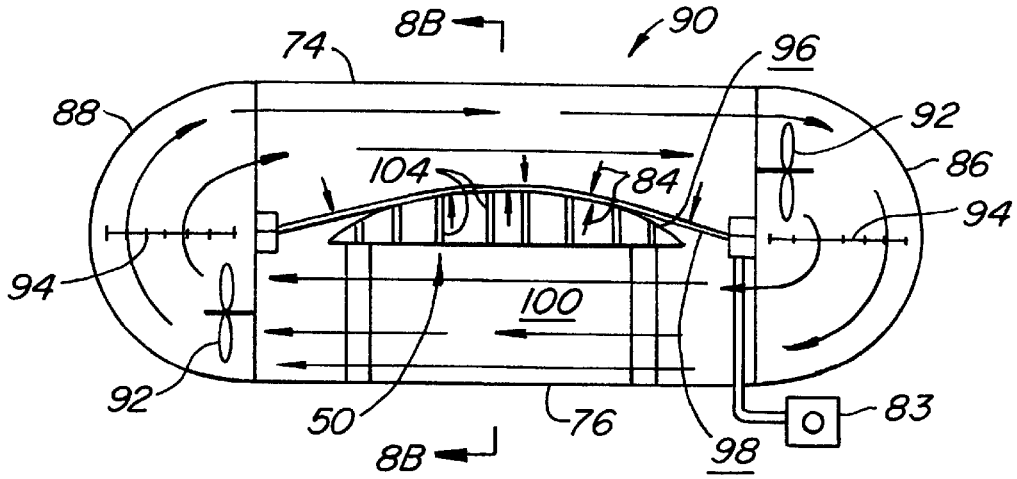
FIG. 8A shows the structure of FIG. 8 after the upper and lower enclosure members have been brought together, capturing the material stack within a lamination interior between the flexible pressure sheets, and placement of first and second end enclosure members adjacent to the open ends of the closed upper and lower enclosure members, each including a recirculating fan and an electric heater element so to cause heated, circulating fluid to pass by the outer surfaces of the flexible pressure sheets, and then application of pressure to the outer surfaces of the flexible pressure sheets by creating a partial vacuum within the lamination interior.
Figure 8B:
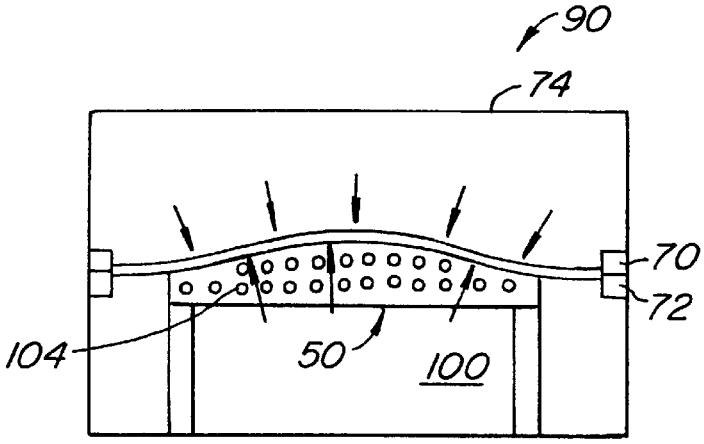
FIG. 8B is a simplified view taken along line 6B—6B of FIG. 8A.

Uncut sail sections 44 may be either flat laminated sections or they may be molded, three dimensional sail sections. FIGS. 8, 8A and 8B illustrate one method for transforming the stack of sectors 30 of prepreg material 20 between films 32 and 42, termed a material stack 64, into uncut sail section 44.

Material stack 64 is positioned between upper and lower flexible pressure sheets 66, 68 as shown in FIG. 8. Pressure sheets 66, 68 are preferably made of a flexible, elastomeric material, such as silicone, which provides high-friction surfaces touching films sides 32, 42 of material stack 64. Upper and lower flexible pressure sheets 66, 68 are circumscribed by upper and lower rectangular frames 70, 72. Frames 70, 72 are mounted to upper and lower enclosure members 74, 76. Each enclosure member 74, 76 is generally three-sided enclosure member with open ends 78, 80. Upper and lower enclosure members 74, 76 carrying frames 70, 72 and flexible pressure sheets 66, 68 therewith, are then brought together as shown in FIG. 8A. A partial vacuum is then created within a lamination interior 82 formed between sheets 66, 68 using vacuum pump 83, thus creating a positive lamination pressure suggested by arrows 84 in FIG. 8A. First and second end enclosure members 86, 88 are then mounted over the open ends 78, 80 of upper and lower enclosure member 74, 76 to create a sealed enclosure 90.

First and second end enclosure members 86, 88 each include a fan 92 and an electric heater element 94. Fans 92 cause air or other fluids, such as oil, within enclosure 90 to be circulated around and over the outer surfaces 96, 98 of flexible pressure sheets 66, 68. This ensures that flexible pressure sheets 66, 68 and material stack 64 therebetween are quickly and uniformly heated from both sides. Because the entire outer surfaces 96, 98 can be heated in this way, the entire material stack 64 is heated during the entire lamination process. This helps to ensure proper lamination. After a sufficient heating period, the interior 100 of enclosure 90 can be vented to the atmosphere and cooled with or without the use of fans 92 or additional fans. After being properly cooled, uncut sail section 44 is removed from between pressure sheets 66, 68.

FIGS. 8, 8A and 8B illustrate the perforated nature of mold element 50 contacting outer surface 98 of lower flexible pressure sheet 68. In the preferred embodiment, perforated mold element 50 is made up of a number of relatively thin vertically-oriented members 104 oriented parallel to one another with substantial gaps therebetween to permit the relatively free access to the heated fluid to lower surface 98. Preferably, no more than about 20%, and more preferably no more than about 5%, of that portion of lower surface 98 which is coextensive with material stack 64 is covered or effectively obstructed by perforated mold element 50. Instead of vertically-oriented members 104, perforated mold element 50 could be made of, for example, honeycomb with vertically-oriented openings. Many dead spaces could be created within the vertically-extending honeycomb channels, thus substantially hindering heat flow to large portions of lower surface 98. This can be remedied by, for example, changing the air flow direction so the air is directed into the honeycomb channels, minimizing the height of the honeycomb, and providing air flow escape channels in the honeycomb near surface 98. Other shapes and configurations for perforated mold element 50 can also be used.

Preferably the heated fluid within interior 100, which may be a gas or a liquid, is in direct thermal contact with upper and lower surfaces 96, 98. However, in some circumstances an interposing surface could be created between the heated fluid and surfaces 96, 98. So long as such interposing surfaces do not create a significant heat barrier, the heated fluid will remain in effective thermal contact with outer surfaces 96, 98 of pressure sheets 66, 68.

Modification and variation can be made to the disclosed embodiments without departing from the subject of the invention defined by the following claims. For example, first and second films 32, 42 may be made of the same or different materials. One or both films 32, 42 may not be imperforate. Section 46 may be joined by other than the broadseaming along adjacent edges 47, such as by conventional straight seaming or gluing techniques.

Any and all patents, patent applications and printed publications referred to above are incorporated by reference.

What is claimed is:

1. A sail body, of the type having expected load lines, comprising:

a plurality of sail sections, having edges, joined along said edges;

each said sail section comprising a reinforced material laminated between first and second films, said reinforced material comprising a plurality of sectors of reinforced material, each having a first set of generally parallel reinforcement elements and a second set of generally parallel reinforcement elements oriented generally perpendicular to the first set of reinforcement elements, said sectors arranged in a partially overlapping pattern so that:

the first set of reinforcement elements of a first sector is at an acute angle to the first set of reinforcement elements of a second, adjacent sector ; and the first set of reinforcement elements of said first and second sectors are generally aligned with the respective expected load lines passing through said first and second sectors.

2. The sail body according to claim 1 wherein said sail sections comprise triangular and quadrilateral sail sections.

3. The sail body according to claim 2 wherein said reinforced material comprises at least two layers of said sectors over at least a portion of said section.

4. The sail body according to claim 1 wherein said reinforced material of one said sail section comprises at least one of woven and unwoven fibers.

5. The sail body according to claim 1 wherein the first and second set of reinforcement elements are made of the same fibrous material.

6. The sail body according to claim 1 wherein the sectors have edges, and wherein the first set of reinforcement elements extend from edge to edge.

7. The sail body according to claim 1 wherein said sail sections are broadseamed along said edges.

8. A method for making a sail body from a plurality of sail sections, each sail section having expected load lines, comprising:

making a sail section by:

selecting sectors of reinforced material, each having a first set of generally parallel reinforcement elements and a second set of generally parallel reinforcement elements, the second set arranged generally perpendicular to the first set;

arranging sectors of the reinforced material in a partially overlapping pattern so that:

the first set of reinforcement elements of a first sector is at an acute angle to the first set of reinforcement elements of a second, adjacent sector; and the first set of the reinforcement elements of said first and second sectors are generally aligned with the respective expected load lines passing through said first and second sectors; and laminating the arranged sectors of reinforced material between a first film and a second film to form a sail section;

repeating the making step to make a plurality of sail sections; and joining the plurality of sail sections to create a sail body.

9. The method according to claim 8 wherein the arranging step is carried out using a reinforced material impregnated with an uncured adhesive.

10. The method according to claim 8 wherein the arranging step is carried out using triangular sectors of material.

11. The method according to claim 8 wherein the arranging step arranges the sectors of reinforced material on the first film.

12. The method according to claim 8 wherein the arranging the step is carried out using elongate sectors of reinforced material.

13. The method according to claim 8 wherein the arranging step is carried out using elongate sectors of reinforced material having lengths and widths, the average lengths, measured generally parallel to the first set of reinforcement elements, being at least about five times the average widths, measured generally perpendicular to the lengths.

14. The method according to claim 8 wherein the joining step comprises broadseaming said sail sections together along adjacent edges of said sail sections.

15. A method for making a sail body from a plurality of sail sections, each sail section having expected load lines, comprising:

making a sail section by:

selecting elongate sectors of reinforced material, at least one of said sectors having a surface area less than half the surface area of the sail section, each said sector having a set of generally parallel reinforcement elements;

arranging sectors of the reinforced material in a partially overlapping pattern so that:

the first set of reinforcement elements of a first sector is at an acute angle to the first set of reinforcement elements of a second, adjacent sector; and the first set of the reinforcement elements of said first and second sectors are generally aligned with the respective expected load lines passing through said first and second sectors, said elongate sectors being impregnated with an adhesive; and laminating the arranged sectors of reinforced material between a first film and a second film to form a sail section;

repeating the making step to make a plurality of sail sections; and broadseaming said sail sections together along adjacent edges of said sail sections to create a sail body.

* * * * *